United States Patent [19]

Clearman

[11] Patent Number: 4,487,368

[45] Date of Patent: Dec. 11, 1984

[54] VANE-DRIVEN WOBBLING SPRINKLER DEVICE

[76] Inventor: Jack F. Clearman, Rte. 4, Blakely, Ga. 31723

[21] Appl. No.: 432,853

[22] Filed: Oct. 29, 1982

[51] Int. Cl.[3] ..... B05B 3/00

[52] U.S. Cl. ..... 239/229; 239/233; 239/237; 239/222.17; 239/383

[58] Field of Search ..... 239/227, 229, 231, 233, 239/237, 222.17, 222.13, 222.15, 222.21, 382, 383, 489, 499, 502, 206, 210

[56] References Cited

U.S. PATENT DOCUMENTS

| | | | |
|---|---|---|---|
| 550,336 | 11/1895 | Williams | 239/489 |
| 1,893,210 | 1/1933 | Rider | 239/489 |
| 2,761,738 | 9/1954 | Swan | 299/126 |
| 2,848,276 | 11/1956 | Clearman | 299/68 |
| 3,081,036 | 3/1963 | Hruby | 239/17 |
| 3,091,400 | 3/1962 | Aubert | 239/261 |
| 3,099,647 | 6/1958 | Hait | 239/206 |
| 3,099,648 | 6/1958 | Hait | 239/201 |
| 3,125,297 | 6/1961 | Copeland et al. | 239/261 |
| 3,175,767 | 1/1963 | Hruby, Jr. | 239/17 |
| 3,312,400 | 4/1967 | Clearman | 239/206 |
| 3,347,464 | 7/1965 | Hruby, Jr. | 239/210 |
| 3,357,643 | 7/1965 | Hruby, Jr. | 239/210 |
| 3,567,124 | 3/1971 | Jones | 239/118 |
| 3,743,187 | 7/1973 | Breunsbach | 239/489 |

FOREIGN PATENT DOCUMENTS

| | | |
|---|---|---|
| 719424 | 4/1942 | Fed. Rep. of Germany . |
| 903592 | 4/1944 | France . |

*Primary Examiner*—John J. Love
*Assistant Examiner*—James R. Moon, Jr.
*Attorney, Agent, or Firm*—Richard E. Brink

[57] ABSTRACT

Lawn sprinkler incorporating a novel water distributing head having a "wobbling" motion. The base of the head is mounted loosely between shoulders near the end of a tubular water-supplying support arm. A water jet emerging from a nozzle at the end of the arm strikes internal vanes at the discharge end of the distributor head to cause the wobbling action. The support arm is journaled within a vertical bearing, and the action of the water jet causes the arm to be driven slowly through a circular path.

9 Claims, 15 Drawing Figures

VANE-DRIVEN WOBBLING SPRINKLER DEVICE

BACKGROUND OF THE INVENTION

This invention relates to sprinklers, especially to sprinklers for supplying water to lawns and other vegetation. A particular feature of the invention is a novel water distributor head.

For many years a great deal of effort has been devoted to developing sprinklers for lawn, crops, etc. These devices have varied widely in complexity, ranging all the way from simple spray nozzles to complex assemblies having water-driven gears and a large number of moving parts. For greatest efficiency, a sprinkler should have a minimal number of moving parts, be designed so that the supply stream of water is not subjected to excessive friction, deliver water in a manner that minimizes loss by evaporation, and be capable of covering a large area. While many prior art sprinklers have possessed some of these characteristics, it is believed that none has possessed all of them.

Illustrative of the prior art devices is that shown in Swan U.S. Pat. No. 2,761,738, where a stream of water impinges on a vaned perforate rotor to distribute droplets instead of a fine spray. Jones U.S. Pat. No. 3,567,124 likewise employs a rotating unit to distribute water over the area to be sprinkled. Rider U.S. Pat. No. 1,893,210 describes a sprinkler having an internally grooved nozzle that is said to deliver water in "gobs or slugs." Hait U.S. Pat. Nos. 3,009,647 and 3,009,648 describe rubber whip type sprinkler heads. Hruby U.S. Pat. Nos. 3,081,036, 3,175,767, 3,347,464, and 3,357,643 all describe sprinklers in which a tubular water distributing stem gyrates around in a tubular body.

Clearman U.S. Pat. No. 2,848,276 discloses a sprinkler utilizing a novel distributor head in which an upwardly directed jet of water strikes the lower surface of an externally grooved inverted conical diverter, which "wobbles", or precesses, to distribute coarse drops of water throughout a circular area. This device is extremely simple and efficient, but the area watered is not so large as is frequently desired.

BRIEF SUMMARY

The present invention provides a sprinkler device incorporating a novel water distributor head. The device is simple and inexpensive to manufacture, employs a small number of moving parts, delivers water with minimum loss by evaporation, and is able to supply water to an extremely large area. Like the distributor head of the aforementioned Clearman patent, the distributor head of the present invention traverses a wobbling, or precessing, path.

The present invention is a sprinkling device comprising an elongate wobbling distributor head having an open discharge end axially spaced from and structurally connected to a closed base end. The base has a circular hole extending generally axially therethrough. The discharge end comprises at least a sector of an annulus provided on its inner peripheral surface with a plurality of inwardly extending vanes aligned at a slight angle to the axis of the distributor head and terminating short of the center of the annulus, leaving a substantial open area.

BRIEF DESCRIPTION OF THE DRAWING

Understanding of the invention will be enhanced by referring to the accompanying drawing, in which like numbers refer to like parts in the several views and in which;

FIG. 11 1s a partial sectional view of the sprinkler of FIG. 1, showing the sprinkler head in the same position as is indicated in FIG. 7;

DETAILED DESCRIPTION

Figure 1:
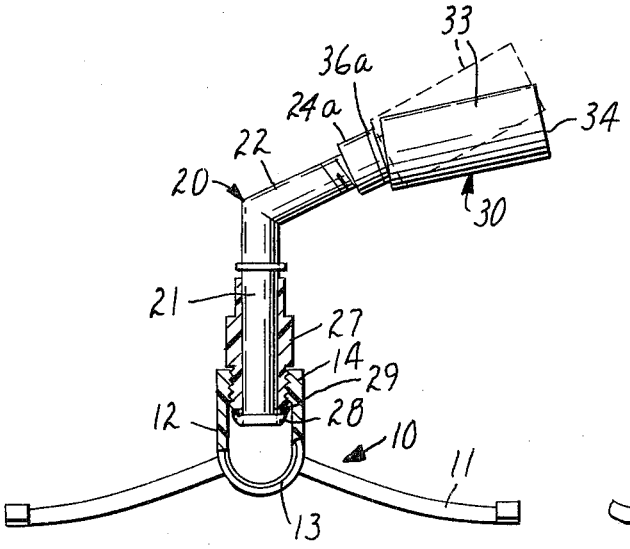
FIG. 1 is a front elevation view of a sprinkler made in accordance with the invention, shown in partial cross-section to facilitate understanding.
Figure 2:
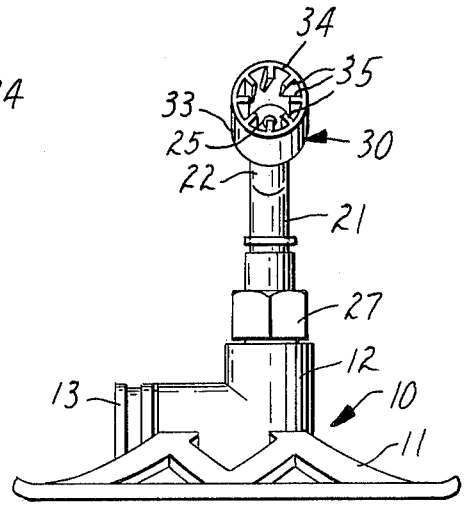
FIG. 2 is a right side elevation view of the sprinkler of FIG. 1.
Figure 3:
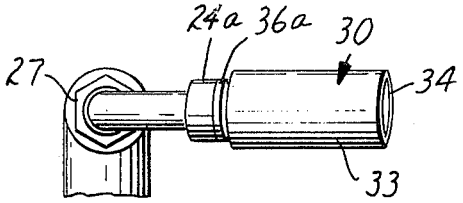
FIG. 3 is a top view of a portion of the sprinkler of FIG. 1.
Figure 4:
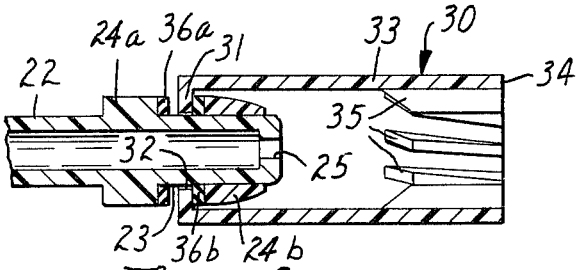
FIG. 4 is a top cross-sectional view of the distributor head of the sprinkler of FIG. 1.
Figure 5:
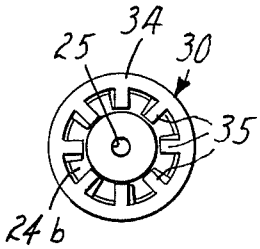
FIG. 5 is an end view of the distributor head of FIG. 4.
Figure 6:
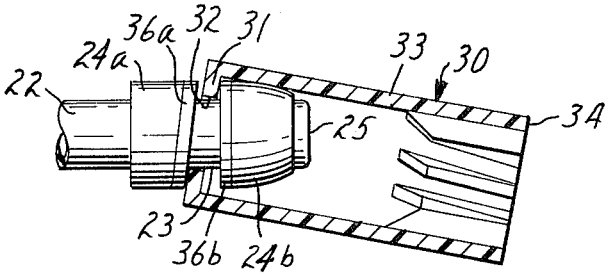
FIG. 6 is a side cross-sectional view of the distributor head of FIG. 4.

First considering the form of the invention depicted in FIGS. 1–12 inclusive, sprinkler base 10 is connected to support arm 20, at the distal end of which is mounted water distributor head 30. Sprinkler base 10 includes ground-contacting sled 11, which supports housing 12. At one side of housing 12 is internally threaded connection 13, providing a means for conveniently attaching the sprinkler to a hose. At the upper side of housing 12 is internally threaded opening 14, into which is screwed vertically extending externally threaded bearing 27.

Support arm 20 includes tubular vertically extending proximal portion 21, which is rotatably and slidable journaled within bearing 27. The lower end of proximal portion 21 is provided with head 28, which extends over the lower end of bearing 27, washer 29 being interposed between the coextensive surfaces to provide an effective water seal while permitting proximal portion 21 to rotate freely within bearing 27.

At the opposite end of support arm 20 is tubular distal portion 22, desirably extending at an angle of about 30° to the horizontal, thereby (as is well known in the sprinkler industry) permitting a stream of water traversing support arm 20 to attain its maximum horizontal distance. The distal end of distal portion 22 is provided with a restrictions, thereby creating nozzle 25 and limiting the diameter of the water jet 26 which passes through support arm 20 during operation of the sprinkler.

Adjacent the distal end of distal portion 22 are spaced shoulders 24*a* and 24*b*, respectively surfaced with rubber washers 36*a* and 36*b*, defining neck 23 therebetween. Mounted on neck 23 is elongate water distributor head 30, comprising closed base end 31, having generally centrally disposed hole 32, which is slightly greater in diameter than neck 23, which it loosely surrounds. The thickness of base end 31 is somewhat less than the distance between washers 36*a* and 36*b*. Integral with base end 31 is generally tubular wall 33, which extends to annular discharge end 34. The interior peripheral surface of annular end 34 is provided with radially inwardly extending vanes 35, which terminate well short of the center of end 34, leaving an unimpeded central open area. Vanes 35 are generally parallel to each other and extend at a slight angle (e.g., 10°–30°) to the longitudinal axis of head 30. Preferably the ends of vanes 35 which are closest to base 31 are tapered to permit smoother water flow around them during operation, thereby enhancing the efficiency of water distribution.

Figure 7:
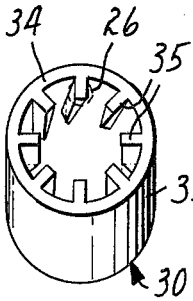
FIGS. 7–10 inclusive show consecutive positions assumed by the distributor head of FIG. 4 during operation.
Figure 8:
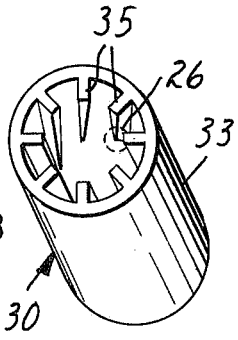
Figure 10:
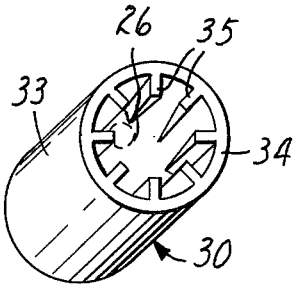
Figure 11:
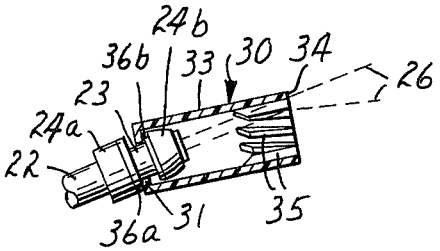

When water is supplied to housing 12 by way of connection 13, the pressure lifts support arm 20, firmly seating the lower end of bearing 27 against the upper surface of washer 29. Water jet 26 then emerges from nozzle 25, imparting a wobbling, or precessing, motion to distributor head 30 in a manner best appreciated by referring to FIGS. 7–10, which illustrate the view from beyond discharge end 34 during four successive operational stages of the sprinkler. As shown in FIGS. 7 and 11, the initial position of distributor head 30 is such that jet 26 strikes those vanes 35 that are located at the top portion of end 34. These vanes 35 break up jet 26 into coarse droplets of water that are distributed relatively close to the ground area immediately adjacent end 34. Simultaneously, however, jet 26 lifts discharge end 34 and, because of the angle of vanes 35, imparts an incremental clockwise wobble thereto. As a result, jet 26 now strikes a portion of those vanes 35 located at 3 o'clock, as is shown in FIG. 8. Once again, water jet 26 is diffused by vanes 35, but because only a portion of jet 26 strikes vanes 35, the distance traversed by the stream of droplets is somewhat farther from end 34.

Figure 9:
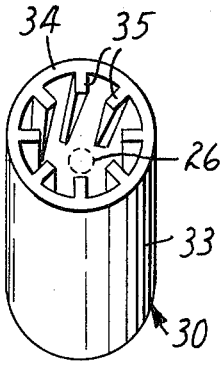
Figure 12:
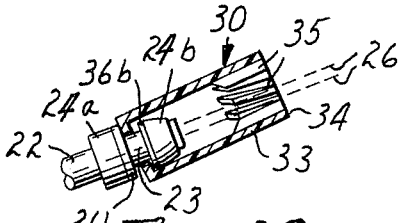
FIG. 12 corresponds to FIG. 11 but shows the sprinkler head inithe same position as is indicated in FIG. 9.

As the action proceeds, the greatest elevation attained by end 34 is shown in FIGS. 9 and 12; here jet 26 is unimpeded and hence attains its greatest distance from end 34. Continuing the wobbling action, the motion of end 34 is such that jet 26 strikes vanes 35 at 9 o'clock, as is shown in FIG. 10. As in FIG. 8, vanes 35 again break water jet 26 into coarse droplets that travel to a distance intermediate discharge end 34 and the maximum distance attained by jet 26 when unimpeded.

During the action just described, base 31 has been restricted in its radial movement, wobbling in a clockwise direction, with the lower surface of base 31 contacting the upper edge of washer 36*a* while the diametrically opposite surface of base 31 contacts the corresponding diametrically opposite edge of washer 36*b* is extremely low friction action, the overall path traversed by head 30 thus being essentially conical. The presence of rubber washers 36*a* and 36*b* not only serves to reduce noise of operation but also permits a slight clockwise rotational advance of head 30 during operation.

The action of water jet 26 in striking vanes 35 imparts yet another motion to the sprinkler of the invention. If, as is evident in FIG. 7, the maximum engagement of vanes 35 by jet 26 occurs at 12 o'clock, distributor head 30 is accelerated at that point, generating its greatest horizontal force and tending to drive arm 20 in a clockwise direction within bearing 27, so that in due course water is distributed over the entire circular area swept by arm 20. If, on the other hand, the alignment of head 30 with respect to nozzle 25 were such that maximum engagement of vanes 35 by jet 26 occurred at 6 o'clock, the resultant forces would drive arm 20 in a counterclockwise direction. For most efficient clockwise drive, the greatest wobble velocity of head 30 should occur at about 3 o'clock, as shown in FIG. 8; if, however, the greatest wobble velocity occurs at about 1:30, the downward force reduces the frictional drag that occurs along the surfaces of seal 29 and, empirically, achieves most efficient driving of arm 20. As will be readily inferred from the foregoing, for most efficient counterclockwise drive, the greatest wobble velocity should correspondingly occur at about 9 o'clock and 10:30.

Figure 13:
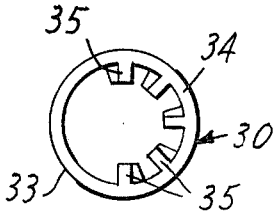
FIG. 13 is a front elevational view of a modified form of sprinkler head made in accordance with the invention.

It is not absolutely essential that vanes 35 extend around the entire inner periphery of annular discharge end 34. Thus, for example, FIG. 13 shows a modification of distributor head 30 in which vanes 35 extend around only about half of the inner peripheral surface of end 34. Indeed, it has been found that it is possible to achieve satisfactory wobbling and drive if vanes 35 extend over as little as 90° of the peripheral surface. For constructions of this type, however, it is essential that distributor head 30 be permitted to wobble but be prevented from advancing during the wobble operation; unless advance is prevented, it is quite possible to stop the sprinkler with head 30 in a position such that jet 26 will not engage vanes 35 when the sprinkler is turned on again. The manner in which advance of distributor head 30 is prevented will be discussed in more detail in connection with another embodiment of the invention.

Figure 14:
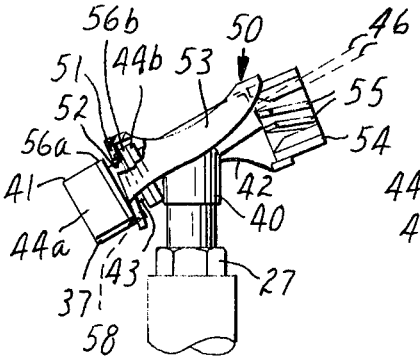
FIG. 14 is a side elevational view of another embodiment of the invention.
Figure 15:
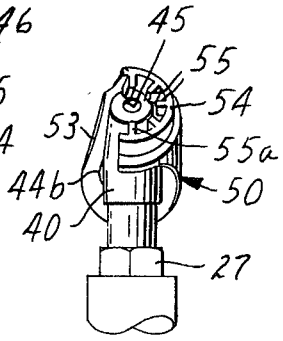
FIG. 15 is a front elevational view of the embodiment shown in FIG. 14.

Turning now to FIGS. 14 and 15, a further modification of the invention will be observed. In this embodiment, support arm 40 extends in opposite radial directions beyond bearing 27, with water distributor head 50 mounted directly thereover. For convenience in discussion, one end portion of support arm 40 will be designated proximal portion 41 and the opposite end will be designated distal portion 42. At the distal end of distal portion 42 is a restriction, creating nozzle 45 and limiting the diameter of water jet 46 which passes through distal portion 42 during operation of the sprinkler.

Located on proximal portion 41 are spaced shoulders 44*a* and 44*b*, defining neck 43 therebetween; shoulders 44*a* and 44*b* are respectively covered by rubber washers 56*a* and 56*b*, for the same sound-reducing reasons discussed previously. Mounted on neck 43 is elongate water distributor head 50, comprising closed base end 51, having centrally disposed hole 52, slightly greater in diameter than neck 43, which it loosely surrounds. The thickness of base end 51 is somewhat less than the distance between washers 56*a* and 56*b*. Integral with base end 51 is open skeletal structure 53, which extends to sector 54 of an annulus, constituting the discharge end of distributor head 50. Mounted along the peripheral interior of sector 54 are vanes 55, all of which are essentially parallel to each other except for vane 55*a*, at one end of sector 54; vane 55*a* lies at a significantly greater angle to the longitudinal axis of head 50 than vanes 55. To ensure that distributor head 50 will not advance during operation of the sprinkler, pin 37 extends from the upper side of shoulder 44*a*, loosely fitting into socket 58 on base 51.

The embodiments of the invention shown in FIGS. 13–15 function in substantially the same manner as the embodiment shown in FIGS. 1–12. In other words, when a jet 26 of water emerges from nozzle 45, it first strikes those vanes 55 which are at the upper end of sector 54, lifting them and imparting a clockwise wobbling motion to distributor head 50. As the wobbling motion proceeds, jet 26 strikes vane 55*a*, its greater angle to the axis of head 50 imparting a horizontal "kick" to head 50 and driving arm 40 through a counterclockwise rotational path within bearing 27. The same effect could be achieved in various other ways, e.g., by maintaining vane 55*a* at the same angle as vanes 55 but increasing its radial length.

It will be apparent to readers of the foregoing description that the relationship of the water jet to the vanes has a significant effect on the way the sprinklers of the invention will operate. Appropriate relationships can be achieved by radially offsetting either the distributor head or the nozzle; similarly, the nozzle can be constructed so that the emerging water jet is at an angle to the axis of the distributor head. The direction of rotation of arm 20 can be rendered either clockwise or counterclockwise by appropriately aligning the nozzle and distributor head or by varying the size or angle of vanes 35.

A number of design parameters will readily occur to those skilled in the art. For example, increasing the distance between shoulders 24*a* and 24*b* will increase the diameter of the conical base generated by head 30 during wobbling; this in turn will cause water to be distributed over a wider angular area but, because jet 26 may never be fully unimpeded, the distance reached will be less. Similarly, decreasing the weight of distributor head 30 (e.g., by utilizing a more skeletal construction) makes it easier to initiate the wobbling cycle. Wobbling may also be achieved at reduced pressure by increasing the angle at which vanes 35 lie with respect to the longitudinal axis of distributor head 30.

It will, of course, be apparent that sprinklers in accordance with the invention could be so constructed that the water jet was at least partially intercepted by the vanes at all times during the wobbling cycle; such a cdnstruction would, however, sacrifice the size of the area which could be covered.

I claim:

1. A sprinkling device for supplying water to lawns, vegetation, and the like, said device comprising an elongate wobbling water distributor head having an open discharge end axially spaced from and structurally joined to a closed base end, said discharge end comprising at least a sector of an annulus provided with a plurality of radially inwardly extending vanes on its inner peripheral surface, said vanes aligned at a slight angle to the logitudinal axis of said head and terminating substantially short of the center of said annulus, said base end having a hole extending generally axially therethrough said device including a support arm having a tubular neck portion with spaced shoulders, said base end being loosely mounted on said neck between said shoulders so as to have limited radial and axial movement.

2. The device of claim 1 wherein the discharge end includes a complete annulus.

3. The device of claim 2 wherein the vanes are present around only a portion of the inner peripheral surface of the annulus.

4. The device of claim 2 wherein the vanes are present around the entire inner peripheral surface of the annulus.

5. The device of claim 3 wherein a solid generally tubular wall connects the discharge end to the base end.

6. The device of claim 5 wherein the axially inward ends of the vanes are tapered, thereby permitting more efficient passage of a jet of water directed toward them from a location adjacent the base end of the distributor head.

7. The device of claim 6 wherein the vanes are aligned at an angle of about 15° to the axis of the distributor head.

8. The device of claim 1, wherein said support arm has a proximal portion and a distal portion, said neck being located at said distal portion, said support arm being adapted for connection to a vertical water source, said distal portion extending upwardly at an acute angle to the horizontal, the distal end of said distal portion being restricted in cross-section to provide a nozzle, the discharge end of the distributor head extending beyond said nozzle, whereby when a jet of water emerges from said nozzle, it strikes the vanes and imparts a wobbling motion to the distributor head, thereby distributing water throughout a sectorial area extending from adjacent said distributor head to the maximum distance reached by an unimpeded jet of water.

9. The device of claim 8 wherein the distal portion of the support arm is integral with a vertically extending tubular means journaled within a surrounding bearing that is adapted for connection to a water source, whereby, when water from said source is supplied to the distal portion of the support arm, a jet of water emerges from the nozzle, the impact of the jet on the vanes of the distributor head causing said support arm to move gradually through a horizontal arcuate path, thereby distributing water throughout the area swept by the distributor head.

* * * * *